US006989127B2

(12) United States Patent
Hirata et al.

(10) Patent No.: US 6,989,127 B2
(45) **Date of Patent: *Jan. 24, 2006**

(54) HEALTH ORNAMENT CONTAINING TITANIUM POWDER AND METHOD FOR MANUFACTURING THEREOF

(75) Inventors: Yoshihiro Hirata, Kyoto (JP); Yoshio Ueda, Kyoto (JP); Hiroaki Takase, Kyoto (JP); Kazuaki Suzuki, Kyoto (JP)

(73) Assignee: Phild Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/332,919

(22) PCT Filed: Mar. 26, 2002

(86) PCT No.: PCT/JP02/02913

§ 371 (c)(1),
(2), (4) Date: May 12, 2003

(87) PCT Pub. No.: WO02/078481

PCT Pub. Date: Oct. 10, 2002

(65) Prior Publication Data

US 2004/0034270 A1 Feb. 19, 2004

(30) Foreign Application Priority Data

Mar. 28, 2001 (JP) ..... 2001-093219

(51) Int. Cl.
*B22F 9/00* (2006.01)

(52) U.S. Cl. ..... 419/67; 75/346; 75/360; 63/11; 264/DIG. 55

(58) Field of Classification Search ..... 63/1.11, 63/3, 11, 33; 2/170; 602/1, 2, 20, 21, 23, 602/27; 148/669; 75/343, 346, 360, 363, 75/364; 419/65–68; 264/DIG. 55
See application file for complete search history.

(56) References Cited

U.S. PATENT DOCUMENTS

| | | | | |
|---|---|---|---|---|
| 5,578,383 A | * | 11/1996 | Beyer et al. | 428/551 |
| 5,901,379 A | * | 5/1999 | Hirata | 2/170 |
| 6,026,330 A | | 2/2000 | Chuang | |
| 6,176,271 B1 | * | 1/2001 | Sayers et al. | 139/383 AA |

FOREIGN PATENT DOCUMENTS

| | | | |
|---|---|---|---|
| JP | 62-263903 | | 11/1987 |
| JP | U 3045835 | | 11/1997 |
| JP | 11-9651 | * | 1/1999 |
| JP | U 3061466 | | 6/1999 |
| JP | 11-2855453 | | 10/1999 |
| JP | 2000-300681 A | | 10/2000 |

* cited by examiner

*Primary Examiner*—Jack W. Lavinder
(74) *Attorney, Agent, or Firm*—Knobbe, Martens, Olson & Bear LLP

(57) ABSTRACT

Manufacture health ornaments such as necklaces, bracelets and wristbands that provide sufficient health-promoting function and effective therapeutic action for a long time, by burning a gaseous mixture of oxygen and hydrogen in high-pressure water, using the resultant gas to heat and granulate titanium material, and combining the obtained titanium powder with an elastomer material.

4 Claims, 3 Drawing Sheets

HEALTH ORNAMENT CONTAINING TITANIUM POWDER AND METHOD FOR MANUFACTURING THEREOF

This application is the U.S. National Phase under 35 U.S.C. §371 of International Application PCT/JP02/02913, filed Mar. 26, 2002, which claims priority to Japanese Patent Application No. 2001-93219, filed Mar. 28, 2001. The International Application was published under PCT Article 21(2) in a language other than English.

TECHNICAL FIELD OF THE INVENTION

This invention pertains to health ornaments such as necklaces and bracelets that contain titanium powder manufactured through a specific method and using the bio-activation function of titanium powder, as well the-method by which these ornaments are manufactured.

BACKGROUND TECHNOLOGY

Increasingly, health-conscious consumers have been wearing various types of health ornaments in recent years, and the market is inundated with products claiming to promote health or cure various maladies. These health products cover many categories, including clothing such as underwear, ornaments such as bracelets and rings, linens, footwear, step-on-type foot massagers, foods and beverages, and various exercise goods, which are commonly used in daily life and for which the demand is expected to grow.

The health-promoting and/or therapeutic effects of products using the lines of magnetic force (magnetism) generated by magnets, far-infrared radiation and electromagnetic waves produced by ceramics, elemental materials such as carbon and germanium, raw materials such as natural minerals and gold/silver foils, functional waters such as a water, and tourmaline, are also reported.

Some of these products, however, apparently lack the health-promoting/therapeutic effects they claim to provide or fail to substantiate such claims. Moreover, there are products that offer little efficacy, take a long time to achieve results, cannot maintain the results for a significant period, or work only under limited conditions. Some are found to accompany various problems, including side effects like cutaneous allergic reaction or an unpleasant feeling when worn. Others are sold for exorbitant amounts of money or are cumbersome to use.

Titanium is a relatively new discovery compared with iron and steel, which have been in use since ancient times. But due to its lightness, excellent strength at high temperatures and superb corrosion resistance, titanium is currently used in numerous fields. In particular, it is widely used as the metal for structural members of aircraft, heat exchangers, etcetera. Titanium is also used in ornaments such as eyeglass frames, golf clubs and other sporting/exercise equipment, medical/dental materials, and so on.

The bio-activation effect and electromagnetic action of metallic titanium, which are known to promote blood circulation and provide other health benefits, are drawing considerable attention of late, and the use of titanium in this field of application has become a hot research topic. Titanium is expected to offer an excellent material for new health-promoting/therapeutic products that will resolve various problems that their conventional counterparts have been unable to help.

As a representative application technology of metallic titanium for ornaments and items for daily use, Japanese Patent Application Laid-open No. 1996-322695 describes bed clothing that applies the principle of electron path to a porous ceramic material containing one of 26 elements, including titanium, to improve one's physical condition while sleeping. In this specification, titanium is mentioned only as one of the 26 elements, and the invention doesn't use titanium as a new material.

In Registered Japanese Utility Model No. 3045835 (1997), a health band of a simple, multiple-layer structure is described, consisting of top and bottom layers that sandwich an intermediate layer in which titanium or a new, titanium-based material such as titanium compound is diffused. It is claimed that the band, which is wrapped around the wrist or ankle, promotes health as the new titanium material promotes blood circulation and metabolism, while preventing the eczema and itchiness associated with allergic reaction to metallic substances because the titanium material has no direct contact with the skin.

In Registered Japanese Utility Model No. 3061466, health slippers consisting of a core material molded in the shape of the human sole, and a curved or projected piece attached to the top of the core material to contact the acupuncture points in the sole of the foot, are described. Colored fabric is bonded to the surface of attached piece using an adhesive containing titanium or a titanium-based material such as titanium compound. The edges of the slipper are raised all around to accommodate the entire foot up to the heel. This product claims to promote blood circulation in the sole of the foot by stimulating the acupuncture points by the curved or projected piece. It is also claimed that the slippers can be manufactured at low cost. However, the actual effects are not satisfactory.

In Japanese Patent Application Laid-open No. 1999-285543, a health-maintenance device is described. It consists of a sintered part made through the partial reduction of titanium oxide, and a semiconductor film formed on its surface. In Registered Japanese Utility Model No. 3068810 (2000), a stylish fashion ring claiming to offer health benefits is described. It consists of a ring or bracelet made through vulcanized forming from a mixture of rubber-molding material, amber powder and titanium-oxide powder, with its outer groove fitted with a ring-shaped piece colored with luminous paint.

New materials based on metallic titanium, as described in these published technologies, are employed in ornaments and items for daily use for the purpose of providing health ornaments that offer superior benefits relative to those of conventional health ornaments by utilizing the bio-activation effect and electromagnetic action of metallic titanium, which are known to promote blood circulation and provide other health benefits. However, the titanium compounds used in the above technologies don't offer sufficient health-promoting function or a pleasant feeling when such ornaments are worn. Additionally, the ornaments haven't been able to provide the level of efficacy expected by the user, even when titanium in an uncompounded, elemental form is used.

DESCRIPTION OF THE INVENTION

Contrastingly, titanium material is chemically stable, not subject to aging or degradation over time, and is not harmful to the human body. However, the health-promoting/therapeutic effect of metallic titanium has been recognized only lately. Currently, the metal is seen to have mysterious effects on the human body through bio-activation and electromagnetic functions. These functions are believed to promote blood circulation and metabolism as well as activate blood/cellular tissues. Titanium is also believed to stimulate the acupuncture points throughout the body through electromagnetic action, etc. Titanium can cause these actions in the body without directly contacting the skin. Further, it can produce the result relatively quickly and maintain the effect for a long time. The actions mentioned above are considered the reason that titanium offers significant health-promotion effects, cures various ailments throughout the body, and improves minor conditions such as fatigue, weakness, headache and lower back pain. These unexplained efficacies of titanium are yet to be fully investigated, and the hypothesis that the very gradual electrical action (very small flow of current) and magnetic action of titanium activate the elemental iron existing within the hemoglobin in the blood stream—or another hypothesis that the tiny electromagnetic waves generated by titanium have certain effects on protein molecules—have yet to be proven scientifically.

This invention aims to produce new health ornaments that utilize these characteristics along with the bio-activation function inherent in metallic titanium. In other words, this invention aims to provide health ornaments that fully utilize the bio-activation function of metallic titanium, generate a pleasant feeling when worn, and promote the user's overall health.

This invention also aims to provide ornaments that produce the result more quickly, maintain the effect for a longer period of time, work on more conditions, prevent side effects such as cutaneous allergic reaction, can be manufactured at lower cost, and do not require a cumbersome procedure to use.

This invention was embodied following a finding that combining a base elastomer material with titanium powder for the purpose of employing the characteristics of the new metallic titanium material achieves an exceedingly favorable result in the manufacture of new health ornaments.

Along with the development of technology for the utilization of titanium powder, the inventors also undertook various studies to solve the problems inherent in the production of titanium metal powder itself, such as how to achieve uniform sphericity and the consistently fine grain size of powder particles while reducing the cost of manufacturing. This effort led to an invention pertaining to a new method of manufacturing titanium metal powder, for which patent applications were filed together with this invention (Japanese Patent Application Nos. 2001-91941 and 2001-91942). It was found that using the metallic titanium powder obtained through this new manufacturing method provides a material for use in this invention that provides superior health-promoting/therapeutic effects.

This invention allows the full use of the characteristics of the new material used for health-promotion and/or therapeutic purposes, by utilizing the titanium powder obtained through the specific manufacturing method described later, instead of using general-purpose titanium compounds or alloys. Additionally, the titanium powder used in this invention provides a sufficient bio-activation function to allow the manufacture of new health ornaments that offer health benefits, etc.

The titanium powder used in this invention, obtained by burning an gaseous mixture of oxygen and hydrogen in high-pressure water and using the resultant gas to heat and granulate metallic titanium, offers far superior bio-activation and health-promoting functions compared with general-purpose titanium compounds and alloys.

The hydrogenation/dehydrogenation method, which is a conventional means used to manufacture titanium powder, uses sponge or molten titanium or titanium material offcuts as the material. The material is heated in hydrogen atmosphere and embrittled by allowing it to absorb hydrogen gas. The embrittled titanium is crushed, and is heated again in a vacuum to allow the release of hydrogen gas, after which it is made into powder form. The rotary electrode method uses round bars formed from molten titanium, or made by forging or rolling molten titanium and then forming the resultant material into a bar shape. The round bar material is rotated at high speed in an inactive gas such as argon or helium, while its tip is melted by a heat source utilizing arc, plasma arc, etc. The molten metal that flows down is spattered by centrifugal force to obtain spherical powder particles.

The atomization method melts the material in a water-cooled copper melting pot using a heat source based on plasma arc, etc., whereby the molten metal flows continuously from one side of the melting pot, and whereupon an inactive gas such as argon or helium is injected onto the flow of molten metal to atomize the molten metal and obtain powder.

The aforementioned general-purpose titanium powder is manufactured through the hydrogenation/dehydrogenation method, rotary electrode method or atomization method, but the powder obtained using these methods is subject to oxygen contamination, poor formability, and even insufficient uniformity of sphericity or consistency of grain size.

The inventors have succeeded for the first time in obtaining titanium powder particles of sufficiently uniform sphericity and consistently fine grain size. It has been found that utilizing the powder provided with this invention results in a significant improvement in the health-promoting/therapeutic functions of the intended product relative to the use of normal titanium powder. The reason for the improved effects is considered to be the titanium powder particle's superior uniformity of sphericity and consistency of grain size, which together enhance the dispersion of titanium in the base material. Also, the small grain size means the surface area per unit mass becomes significantly large, and the metallic titanium powder particles are very pure and of fine grain size.

During the development of this invention, the inventors also developed a new method for the manufacture of metallic titanium powder (Japanese Patent Application Nos. 2001-91941 and 2001-91942), by undertaking various studies to solve the problems of non-uniform sphenrcity and inconsistent grain size of powder particles as well as the high cost of manufacturing. This invention was completed using this new titanium powder material, when the inventors realized the superior effect of the metallic titanium powder obtained through this new manufacturing method, which can be embodied by applying it as the new material for health-promotion/therapeutic use as aspired to by this invention.

The method of manufacturing titanium powder developed by the inventors burns a gaseous mixture of oxygen hydrogen in high-pressure water and uses the resultant gas to heat and granulate metallic titanium. It doesn't use conventional methods such as thermal melting or common heating methods such as arc discharge and laser irradiation. It doesn't use the flow-down of molten metal or its spattering/atomization for granulation, either, thus achieving the manufacture of metal powder at a very high level of efficiency. Since the process is free from the generation of byproducts or impurities other than the intended titanium powder, the obtained powder particles offer uniform sphericity and consistent grain size. Finally, this process can achieve a significant reduction in manufacturing cost.

DESCRIPTION OF THE SYMBOLS

Figure 1:
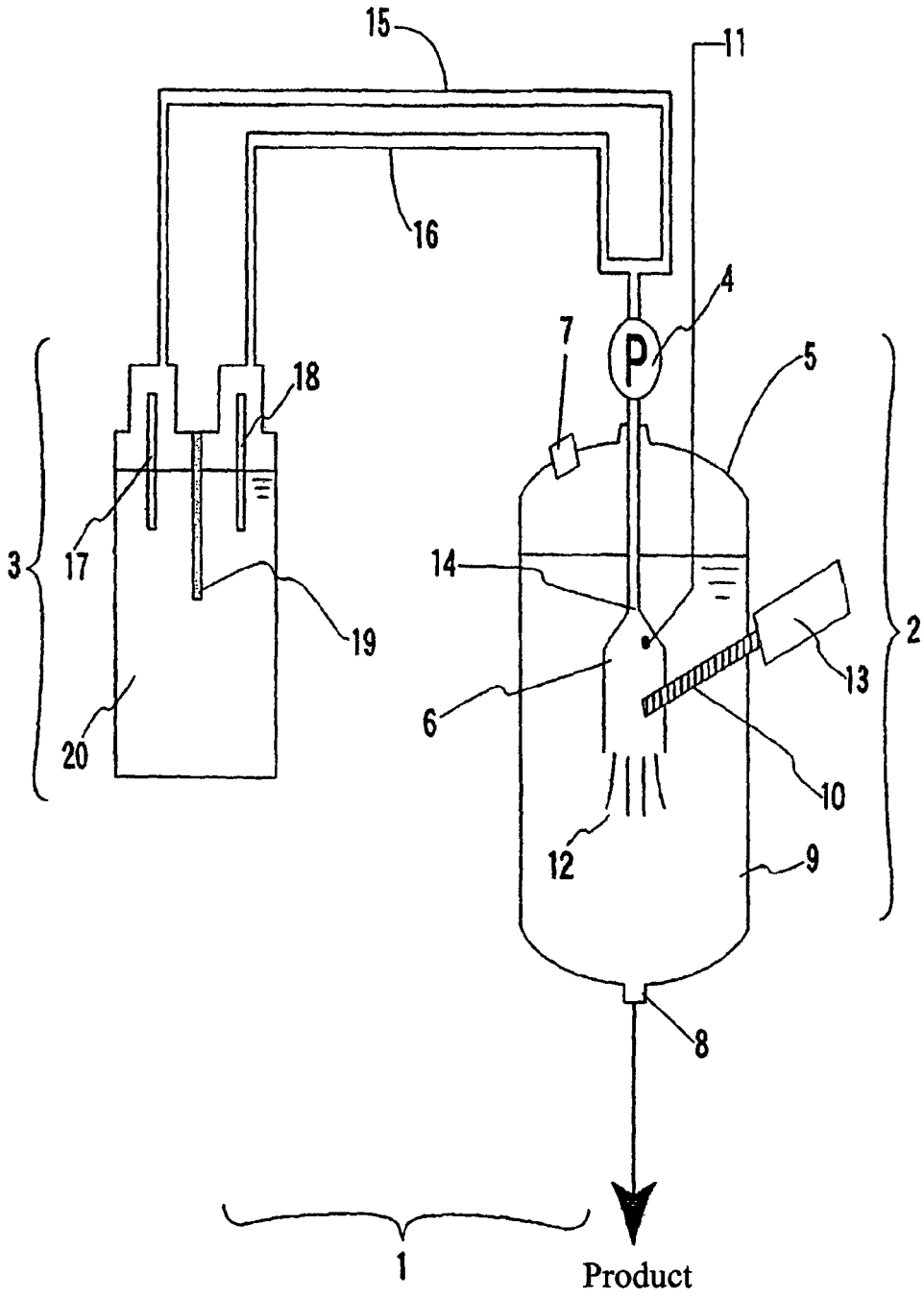
FIG. 1 Manufacturing System for Titanium Powder Used in This Invention

1 Metal-powder manufacturing system
2 Pressure-resistant container for manufacture of metal powder
3 Electrolysis unit
4 Mixture-gas injection pump
5 High-pressure water tank
6 Combustion chamber
7 Pressure-regulator valve
8 Metal-powder outlet
9 Purified water
10 Metal material
11 Ignition plug
12 Metal particle
13 Material-titaniumn feed part
14 Mixture-gas injection nozzle
15 Hydrogen-gas feed pipe
16 Oxygen-gas feed pipe
17 Electrode
18 Electrode
19 Partition
20 Water
21 Process sheet material
22 Titanium powder
23 Base elastomer material
24 Surface layer
25 Bracelet
26 Arm

OPTIMAL EMBODIMENTS OF THE INVENTION

The basic structure of this invention is to combine elastomer with titanium powder, using titanium powder manufactured by a new, special method. The structure of this invention is defined in (1) through (3) below:

(1) Health ornaments made of an elastomer material, which is combined with the titanium powder obtained by burning a gaseous oxygen-hydrogen mixture in high-pressure water and using the resultant gas to heat and granulate titanium metal.

(2) Manufacturing method of health ornaments that involves the burning of an oxygen-hydrogen mixture gas in high-pressure water, using the resultant gas to heat and granulate titanium metal, and combining the obtained titanium powder with an elastomer material.

(3) Heath ornaments defined in (1) above, which are shaped in the form of a necklace, bracelet, wristband, supporter or hair band.

In the definition in (1), an oxygen-hydrogen mixture gas is burned in high-pressure water and the resultant gas is used to heat and granulate the metallic titanium. The titanium powder thus obtained is then combined with an elastomer material and used as the forming material for health ornaments. The use of elastomer as the base forming material makes the forming and processing easier. The natural flexibility of elastomer makes it easy to form and process the material into health ornaments, while its softness, comfortable touch to the skin and heat-conductivity help generate a soft, pleasant feeling when the accessory is worn. Since the titanium material has no direct contact with the skin, there is no worry about possible eczema or itchiness caused by an allergic reaction to metal.

Elastomer, used as the base material in this invention, is a general term for any of several polymeric materials having elasticity. It covers rubber materials and thermoplastic elastic resins, including natural rubber, synthetic rubber such as chloroprene rubber and NBR, thermoplastic polyurethane, and foamed resin. Of these materials, thermoplastic polyurethane is particularly comfortable to wear and is thus desirable in the context of this invention.

Titanium powder, as used in the production of health ornaments intended by this invention, has uniform sphericity and a constant grain size of micron order. It is far superior to the general-purpose titanium powder in terms of its dispersibility in the base material.

It is thus appropriate for this purpose to use titanium powder manufactured by burning a gaseous oxygen-hydrogen mixture in high-pressure water and using the resultant gas to heat and granulate metallic titanium. The powder obtained using the manufacturing method (Japanese Patent Application Nos. 2001-91941 and 2001-91942) developed by the applicant is particularly desirable.

Titanium powder is combined with an elastomer material by kneading it into the elastomer using the kneading and mixing method, etcetera. In this way, the favorable dispersion of titanium powder can be achieved. It is also possible to mix in titanium powder during the elastomer manufacturing process. The composite material comprised of elastomer material and titanium powder can be used in calendar molding, extrusion molding, injection molding and compression molding.

Titanium powder on the order of one to five parts by weight is combined with 100 parts by weight of elastomer. If the amount of titanium powder is less than one part, the characteristic functions of the titanium powder cannot be achieved. On the other hand, economy will be lost if the amount surpasses five parts, because the functions do not improve proportionately when the titanium powder is used to excess.

The structure of this invention is explained in detail by referring to the drawings.

Figure 2:
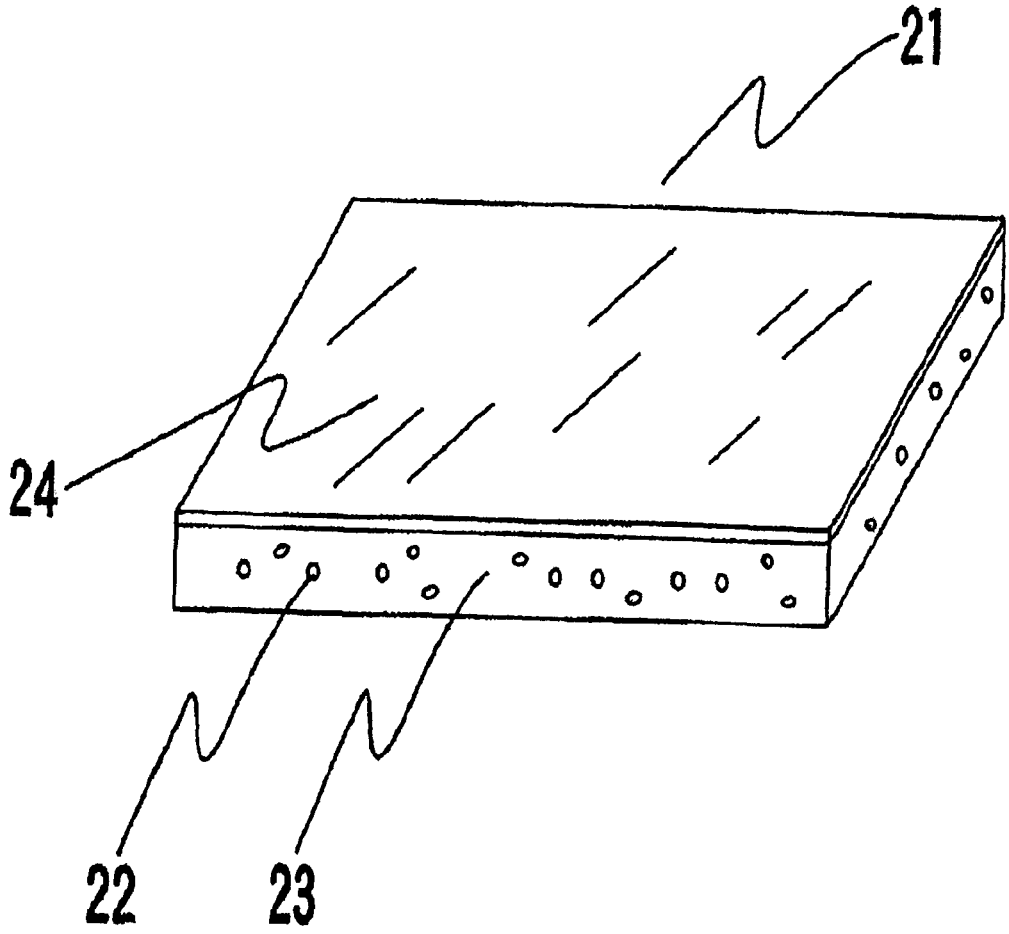
FIG. 2 Process Sheet Material for Making Health Ornaments Intended by This Invention FIG. 3 Product Intended by This Invention (bracelet)
Figure 3:
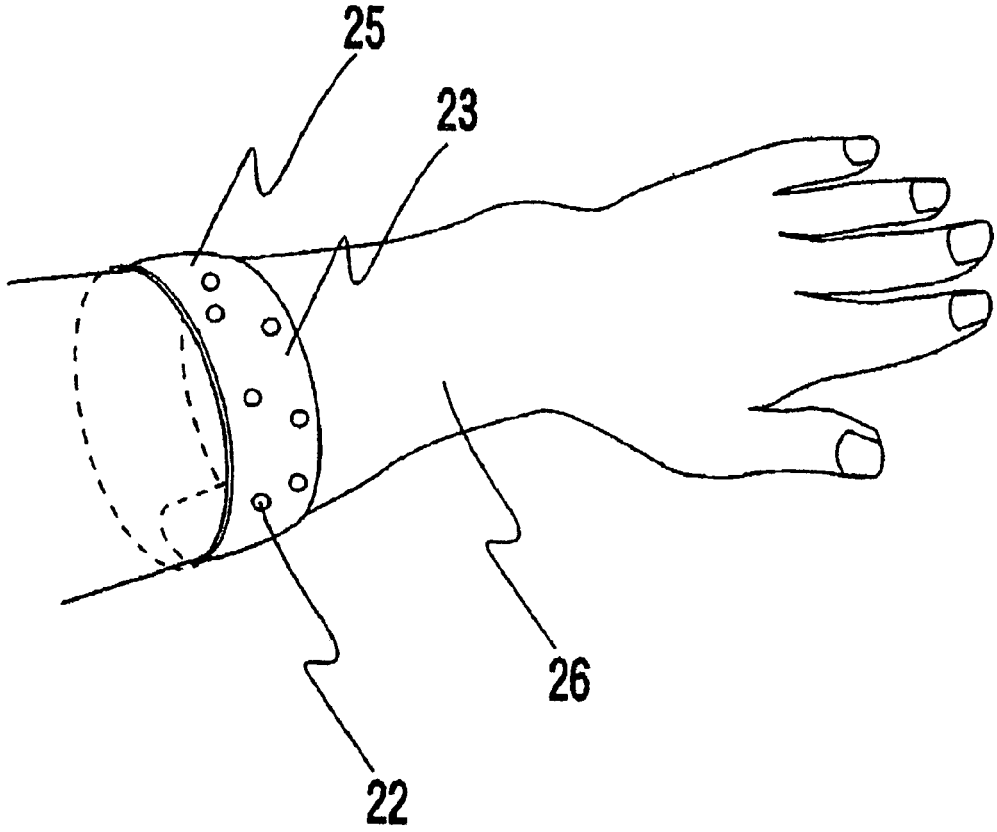

FIG. 1 indicates a manufacturing system for titanium powder used in this invention, while FIG. 2 shows process sheet material for making the health ornaments intended by this invention. FIG. 3 shows a bracelet product intended by this invention.

The manufacture of metallic titanium powder in this invention is described by means of the process flow in the manufacturing system for metallic powder indicated by 1. A high-pressure water tank (5) within a pressure-resistant container for the manufacture of metallic titanium powder (2) is filled with purified water (9) such as distilled water. Metallic titanium (10), such as a titanium metal bar, is fed from a metal-material feed part (13) and pressurized. Hydrogen and oxygen are injected through a nozzle (14) as a gaseous mixture, which is ignited by an ignition plug (11). The gaseous mixture is burned completely in a combustion chamber (6) into ultra-high-temperature steam gas. The metallic titanium is melted instantly in this steam gas and is then dispersed in water. At this time, extremely fine titanium particles of micron scale (12) are generated and scattered as powder particles. Titanium metal powder particles precipitate quickly, without melting or floating, after which they are separated and removed via a titanium-powder outlet (8) to become the intended product.

The supply of hydrogen-oxygen mixture gas must be controlled accurately so as to maintain the ratio of hydrogen to oxygen at 2:1. The gaseous hydrogen-oxygen mixture is supplied from commercial gas cylinders, but 100-percent pure gases can be obtained by adding a mechanism for electrolysis (3) and producing a gaseous mixture of hydrogen and oxygen via electrolysis of water, thus facilitating the efficient supply of mixture gas. The electrolysis mechanism (3) consists of a partition (19) and an electrolytic bath (20) having electrodes (17 and 18), while hydrogen gas and oxygen gas are fed into the combustion chamber through their respective feed pipes (15 and 16).

Hydrogen-oxygen mixture gas can be burned most efficiently and stably in water, and this water matrix must be compressed sufficiently to allow stable combustion. The reason the metal material melts instantly in the steam gas existing in high-pressure water and becomes ultra-fine particles is yet to be explained from the viewpoint of physical chemistry.

In this invention, titanium powder can be manufactured quite efficiently. At the same time, powder particles of uniform sphericity and consistent grain size can be obtained at significantly lower cost, because no byproducts or impurities other than the metal powder are generated. To actually achieve such efficient production of titanium powder, it is important to control the amount of gaseous mixture to be burned, along with the reaction pressure and the amount of titanium metal supplied.

This invention provides health ornaments in the form of a necklace, bracelet, wristband, supporter or hair band. These health ornaments are formed from a composite material consisting of titanium powder dispersed in an elastomer material. The elastomer, with its flexibility and excellent formability, makes it extremely easy to shape the material into the above products.

As shown in FIG. 2, the process material used for making the health ornaments intended by this invention consists of titanium powder (22) dispersed in a base elastomer material (23). A surface layer (24) may be provided on the elastomer surface, if necessary. In the process sheet material (21) shown in FIG. 2 used for making health ornaments, titanium powder (22) is dispersed in a base elastomer material (23). A surface layer (24) may be provided on the elastomer surface, if necessary. The bracelet (25) shown in FIG. 3 is worn around an arm (26), and consists of titanium powder (22) dispersed in a base elastomer material (23). For decorative purposes a patterned surface layer (24) is provided on the surface of the elastomer material.

Table 1 below shows the result of wearing the products (necklaces) for 10 days obtained via the methods described in the example and respective comparisons specified below.

EXAMPLE 1

A necklace made of a material containing five parts by weight of titanium powder obtained per the manufacturing method under this invention, and 100 parts by weight of commercially available thermoplastic polyurethane elastomer.

Comparison 1

A necklace made of a material containing five parts by weight of commercially available magnetic granules and 100 parts by weight of commercially available thermoplastic polyurethane elastomer.

Comparison 2

A necklace made of a material containing five parts by weight of commercially available titanium powder and 100 parts by weight of commercially available thermoplastic polyamide resin.

Comparison 3

A necklace made of a material containing five parts by weight of commercially available titanium-oxide powder and 100 parts by weight of commercially available thermoplastic polyurethane elastomer.

Subjects: Ten adult men and women were asked to wear the above bracelets and evaluate the following points after 10 days:

Wearing feeling: ⊙ Very good, ○ Good, Δ Average, ▲ Poor, X Very poor

Improvement of health: (Same as above)

Recovery from fatigue: (Same as above)

Recovery from muscle pain: (Same as above)

Recovery from eye fatigue: (Same as above)

TABLE 1

| | Wearing feeling | Improvement of health | Recovery from fatigue | Recovery from muscle pain | Recovery from eye fatigue |
|---|---|---|---|---|---|
| Example 1 | ⊙ | ⊙ | ⊙ | ○ | ⊙ |
| Comparison 1 | ⊙ | ○ | Δ | ○ | ○ |
| Comparison 2 | X | ○ | ○ | ○ | Δ |
| Comparison 3 | ○ | Δ | Δ | X | X |

EXAMPLE 2

Whether or not the health ornaments pertaining to this invention maintain their efficacy over a long period of time was monitored/tested based on the same evaluation criteria defined in the test involving example 1.

A wristband made of a material containing five parts by weight of the titanium powder manufactured per the method under this invention, and 100 parts by weight of commercially available thermoplastic polyurethane elastomer.

Comparison 4

A wristband made of a material containing five parts by weight of commercially available far-infrared radiation ceramics and 100 parts by weight of commercially available thermoplastic polyurethane elastomer.

Subjects: Ten adult men and women were asked to wear the above wristbands for one week, one months and three months, and to evaluate the efficacy after each period.

a: Improvement of health: ⊙ Very good, ○ Good, Δ Average, X No effect b: Recovery from fatigue: (Same as above)

TABLE 2

| | | After one week | After one month | After three months |
|---|---|---|---|---|
| Example 2 | a | ⊙ | ⊙ | ⊙ |
| | b | ⊙ | ⊙ | ⊙ |
| Comparison 4 | a | ○ | Δ | X |
| | b | Δ | X | X |

EVALUATION OF RESULTS

The result of the test involving example 1 found that the health accessory made of a titanium powder-containing elastomer material per this invention offers far greater efficacy than the conventional health ornaments using magnets, etc., in terms of improved health and recovery from fatigue, muscle pain and eye fatigue. In particular, the efficacy of the titanium powder manufactured per the third technology developed as part of this invention is significant.

Titanium powder also offers better efficacy compared to titanium compounds, and the use of elastomer is clearly known to generate a good wearing feeling.

From the above, it is suggested that titanium powder provides health benefits such as promotion of blood circulation and metabolism as well as the activation of blood/cellular tissues.

The result of test involving example 2 found that the health accessory made of a titanium powder contained in elastomer material per this invention maintains its efficacy for a longer period of time than do the conventional products.

Industrial Field of Potential Application

This invention provides new health ornaments made of a titanium-based material consisting of an elastomer containing titanium powder, which takes the maximum advantage of the health-promoting/therapeutic effects of metallic titanium to promote health and cure diseases. Additionally, these health ornaments can be formed/processed easily at lower cost, their results can be experienced more quickly, their efficacy maintained for a longer time, and their benefits extended to more conditions. Elastomer's softness, comfortable touch to the skin and heat-conductivity help generate a soft, pleasant feeling when the accessory is worn. Since the titanium material has no direct contact with the skin, there is no worry about possible eczema or itchiness caused by an allergic reaction to metal.

What is claimed is:

1. A method of manufacturing health ornaments, which comprises:

burning a gaseous mixture of oxygen and hydrogen in high-pressure water;

using the resultant gas to heat and granulate metallic titanium, thereby obtaining a titanium powder; and combining the titanium powder with an elastomer material to manufacture the health ornaments.

2. The method according to claim 1, wherein the health ornaments are shaped in the form of a necklace, bracelet, wristband, supporter or hair band.

3. The method according to claim 1, wherein the titanium powder is contained in an amount of 1 to 5 parts by weight per 100 parts by weight of the elastomer material.

4. The method according to claim 1, wherein the elastomer material is thermoplastic polyurethane.

* * * * *